US012768182B2

(12) United States Patent
De Almeida Borges

(10) Patent No.: US 12,768,182 B2
(45) Date of Patent: Oct. 20, 2026

(54) DOUBLE SHIELD REINFORCEMENT

(71) Applicant: Carlos Alberto De Almeida Borges, Rio de Janeiro (BR)

(72) Inventor: Carlos Alberto De Almeida Borges, Rio de Janeiro (BR)

(73) Assignee: Carlos Alberto De Almeida Borges, Rio de Janeiro (BR)

( * ) Notice: Subject to any disclaimer, the term of this patent is extended or adjusted under 35 U.S.C. 154(b) by 170 days.

(21) Appl. No.: 18/483,195

(22) Filed: Oct. 9, 2023

(65) Prior Publication Data

US 2024/0309663 A1 Sep. 19, 2024

(30) Foreign Application Priority Data

Mar. 14, 2023 (BR) ..... 1320230047369

(51) Int. Cl.

| | |
|---|---|
| ***E04G 23/02*** | (2006.01) |
| ***E04C 3/04*** | (2006.01) |
| ***E04C 3/08*** | (2006.01) |

(52) U.S. Cl.

CPC ..... *E04G 23/0218* (2013.01); *E04C 3/08* (2013.01); *E04C 2003/0486* (2013.01); *E04C 2003/0491* (2013.01)

(58) Field of Classification Search

CPC ..... E04G 23/0218; E04B 1/215; E04C 3/08; E04C 2003/0486; E04C 2003/0491

See application file for complete search history.

(56) References Cited

U.S. PATENT DOCUMENTS

| | | | |
|---|---|---|---|
| 2,152,189 | A | 3/1939 | Albert |
| 2,284,898 | A | 6/1942 | Hartman |
| 2,514,607 | A | 7/1950 | Mclean |
| 3,152,671 | A | 10/1964 | Mallory, Jr. |

(Continued)

FOREIGN PATENT DOCUMENTS

| | | |
|---|---|---|
| BR | PI 7805402-8 | 8/1978 |
| BR | PI 8504326-5 | 4/1987 |

(Continued)

OTHER PUBLICATIONS

Brazilian Standard, NBR 14762, "Dimensionamento de Estruturas de Aco Constituidas por Perfis Formados a Frio—Design of Cold-Formed Steel Structures", Associacao Basileira de Normas Tecnicas, ABNT 2010, pp. 1-93 with English Translation of relevant pp. 65-68.

*Primary Examiner* — Andrew J Triggs
(74) *Attorney, Agent, or Firm* — Chrisman Gallo Tochtrop LLC

(57) ABSTRACT

The present invention is characterized as a new version of the invention called SHIELD REINFORCEMENT (20), owned by the same applicant, and the present invention aims to reinforce the connections in a metallic covering to support loads higher than those that the connections are resistant by themselves. The present invention comprises, as shown in FIGS. 4A, 4B, 4C, 5A, 5B and 5C, two double-shield reinforcement models (22 and 23), and comprising an improvement to an original shield reinforcement (20) applied to a specific covering system (3), it can be considered in the calculation as if the connection was divided into two parts: shield connection (9) with a diagonal (11); and double-shield reinforcement connection (22 and 23) with a diagonal (11).

14 Claims, 7 Drawing Sheets

(56) References Cited

U.S. PATENT DOCUMENTS

| | | | | |
|---|---|---|---|---|
| 3,336,717 | A | 8/1967 | Ward, Jr. | |
| 3,826,057 | A | 7/1974 | Franklin | |
| 3,857,218 | A | 12/1974 | Gilb | |
| 3,966,164 | A | 6/1976 | Dashew | |
| 3,977,536 | A | 8/1976 | Moore | |
| 4,003,179 | A | 1/1977 | Gilb | |
| 4,050,210 | A | 9/1977 | Gilb | |
| 4,077,176 | A | 3/1978 | Bauer | |
| 4,569,501 | A | 2/1986 | McCracken | |
| 4,585,204 | A | 4/1986 | Parker | |
| 4,790,113 | A | 12/1988 | Gregory | |
| 4,831,797 | A | 5/1989 | Vladikovic | |
| 4,833,844 | A | 5/1989 | Wiklund | |
| 4,862,662 | A | 9/1989 | Eberle | |
| 5,251,412 | A | 10/1993 | de Almeida Borges | |
| 5,273,415 | A | 12/1993 | Jackson | |
| 5,390,460 | A | 2/1995 | Llorens | |
| 5,651,229 | A | 7/1997 | Wada | |
| 5,660,017 | A | 8/1997 | Houghton | |
| 5,857,306 | A | 1/1999 | Pellock | |
| 6,138,427 | A | 10/2000 | Houghton | |
| 6,892,502 | B1 | 5/2005 | Hubbell | |
| 6,928,782 | B2 | 8/2005 | Becker | |
| 8,056,291 | B1 | 11/2011 | diGirolamo | |
| 8,146,322 | B2 | 4/2012 | Karns | |
| 8,459,604 | B2 * | 6/2013 | Smith | H02G 3/0608 248/57 |
| 8,881,486 | B2 | 11/2014 | Robinson | |
| 9,209,609 | B2 * | 12/2015 | Kellerman | E04B 1/5812 |
| 10,190,308 | B2 | 1/2019 | De Almeida Borges | |
| 10,697,172 | B2 * | 6/2020 | De Almeida Borges | E04B 1/388 |
| 2005/0204684 | A1 | 9/2005 | Houghton | |
| 2006/0053732 | A1 | 3/2006 | Watson | |
| 2010/0044524 | A1 | 2/2010 | Sugaya | |
| 2010/0086348 | A1 * | 4/2010 | Funahashi | H02G 3/0456 403/306 |
| 2011/0203217 | A1 | 8/2011 | Dayton | |
| 2013/0042568 | A1 | 2/2013 | Davis | |
| 2013/0283728 | A1 | 10/2013 | Chang | |
| 2014/0075875 | A1 | 3/2014 | Dayton | |
| 2016/0298333 | A1 | 10/2016 | Hsieh | |
| 2018/0155918 | A1 | 6/2018 | De Almeida Borges | |
| 2019/0177965 | A1 | 6/2019 | De Almeida Borges | |
| 2022/0243481 | A1 * | 8/2022 | Freeman | E04F 13/144 |

FOREIGN PATENT DOCUMENTS

| | | |
|---|---|---|
| BR | PI 9100456-0 | 9/1992 |
| BR | PI 9304495-0 | 7/1995 |
| BR | PI 9601145-9 | 1/1998 |
| BR | PI 0902183-3 | 12/2010 |
| BR | 102016014526-0 | 1/2018 |
| BR | 102017026394-0 | 6/2019 |
| WO | 2011116437 | 9/2011 |
| WO | 2017219104 | 12/2017 |

* cited by examiner

DOUBLE SHIELD REINFORCEMENT

SUMMARY OF INVENTION

The present invention is characterized as a new version of the invention called SHIELD REINFORCEMENT (20), owned by the same applicant. The object of this invention is to reinforce the connections in a metallic covering to withstand loads higher than those that the bonds resist by themselves.

BACKGROUND OF THE INVENTION

The device of the present invention directly derives and complements several inventions owned by the applicant, the first configuration having been filed with the INPI on Aug. 21, 1978 (PI 7805402-8), the second on Sep. 9, 1985 (PI 8504326-5), the third on Feb. 5, 1991 (PI 9100456-0), the fourth on Nov. 5, 1993 (PI 9304495-0), the fifth on Mar. 27, 1996 (PI 9601145-9), the sixth on Mar. 23, 2009 (PI 0902183-3), the sixth on Jun. 20, 2016 (BR102016014526-0), and the last on Jul. 12, 2017 (BR102017026394-0), said documents being referenced for prior art purposes.

The first configuration (basic structure) is defined by the parts 1—Upper/Lower frame, parts 11—Structure Diagonals, parts 12—Connecting Crossings, parts 4—Counter-diagonals, parts 15—Cover Plate (tile). (FIG. 1A).

The constant change in needs imposed by the coverage market required a new adaptation of the product. One of the main changes continues to concern the overload imposed on the coverage. There is a need to use this cover system with a total overload higher, with higher wind requests, and in some countries, even snow. In addition, the utility load assigned to a roof is also higher. The coverage of a mall, for example, in addition to supporting the already exemplified loads, of plaster lining, electricity pipe rack, sprinkler distribution network, and more, can count on other elements. Photovoltaic power plates have been widely used on metal roofs.

Thus, even with the improvement of the connection of the SHIELD REINFORCEMENT (20), the sizing of the structure continues to be limited by the capacity of the connections between the two parts. In the case of the system initially revealed the structure thereof is comprised of latticed metal beams, with screwed connections between the parts: frame (1) and diagonal (11).

For dimensioning these connections, the resistance of the screw to cutting (FIG. 3A), the crushing of the hole (FIG. 3B) and the longitudinal (FIG. 3C) and transverse tears of the connected plates are considered.

As shown in FIGS. 3A, 3B and 3C, which refer to perspective views of a two-diagonal connection (11) to a shield (9) of the frame (1) of a beam of the covering structure, FIG. 3B shows a perspective view of a two-diagonal connection (11) to a shield (9) of the frame (1) of a beam of the covering structure, highlighting the crushing of the shield bore (9) due to the action of a supposed critical load, with stress vector.

To increase the resistance of the screw to cutting, special steel alloys can be used, or their diameter increased.

In the case of the plate, the increase in its resistance to the effects—crushing of the hole or tearing—is due to the increase in its thickness, which causes the entire piece to become very heavy, making the beam more expensive. The increase in thickness does not apply to parts or sections of the plate, but to its entire length, making it unfeasible to reinforce this or that point through increase in thickness.

Among these three situations shown in FIGS. 3A, 3B and 3C, for the configuration under study, the collapse will occur most often due to the loss of resistance generated by the crushing of the hole. Still using the last invention previously presented—we will now call it SIMPLE SHIELD REINFORCEMENT (20)—the resistance of the shield connection (9) with the diagonals (11) is approximately 40% lower than the compressive strength of the diagonal profile (11). That is, there is an oversizing of the diagonals (11) to compensate for a slightly lower efficiency of the connection.

In view of this, a piece was developed that reinforces the area of the connection called the shield (9), keeping unchanged the thickness of the frame forming plate (1), and, unlike the simple shield reinforcement (20), increasing the fixation from 2 to 4 screws. Thus, the frame (1) continues to have the standard thickness, having its shields (9) reinforced and connected to the diagonals (11) by an extra pair of connectors. This piece was called DOUBLE SHIELD REINFORCEMENT (22 and 23), evidenced in FIGS. 4A, 4B, 4C, 5A, 5B and 5C.

DESCRIPTION OF THE FIGURES

FIGS. 2A, 2B and 2C refer to the development of the structure part (1) of the structure of the system initially disclosed, wherein:

FIG. 2A refers to the development of the structure part (1) of the structure of the system initially disclosed, with shield fins (9), holes (9*a*, 9*b*), and tears (RE) into which the shield reinforcement tabs (20*d*) and the double shield reinforcement tabs (22*g*) will be inserted.

FIG. 2B refers to the perspective view of a frame (1), where one can see, just below each shield (9), the tears in which the tabs of the shield reinforcement (20*d*) will be inserted; and FIG. 2C refers to the side view of a frame (1), where one can see, just below each shield (9), the tears in which the shield reinforcement tabs (20*d*) will be inserted.

FIG. 3A refers to the perspective view of a two-diagonal connection (11) to a shield (9) of the frame (1) of a beam of the covering structure, highlighting the rupture of the screws, due to the action of a supposed critical load, with a stress vector and illustrating the movement of the diagonal (11) upwards with the section of the head of the fixing screw of it in the frame.

FIG. 3B refers to the perspective view of a two-diagonal connection (11) to a shield (9) of the frame (1) of a beam of the covering structure, highlighting the crushing of the shield bore (9) due to the action of a supposed critical load, with stress vector.

FIG. 3C refers to the perspective view of a two-diagonal connection (11) to a shield (9) of the frame of a beam of the covering structure, highlighting the tearing of the shield plate due to the action of a supposed critical load, in sequence to the crushing shown in FIG. 5B, with stress vector.

DESCRIPTION OF THE INVENTION

Figure 1A:
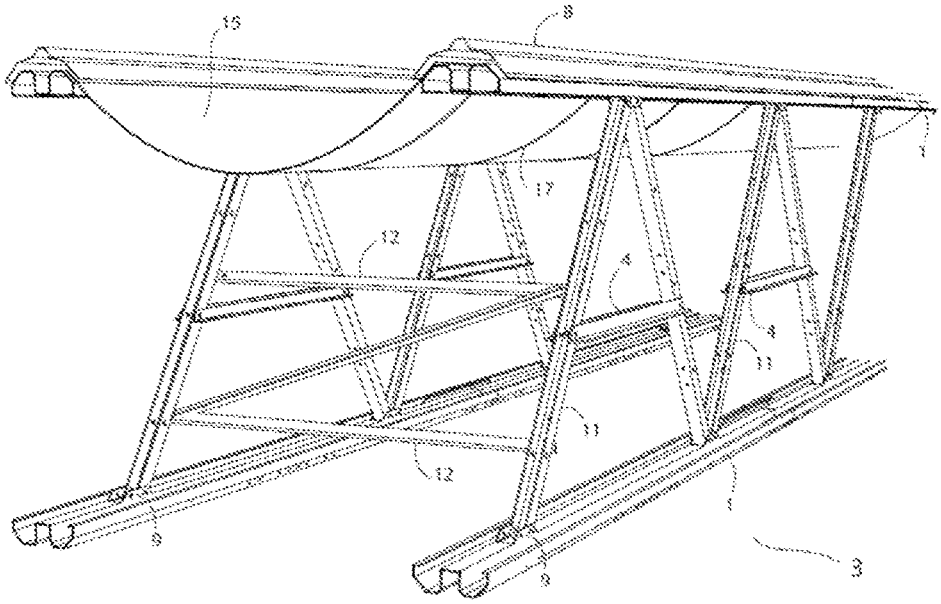
FIG. 1A refers to a perspective view of the covering structure of the system initially disclosed (3), showing the frame (1), the diagonals (11), the crossings (12), the joint cover (8), the tile/covering (15), the counter-diagonals (4) and shields (9)
Figure 1B:
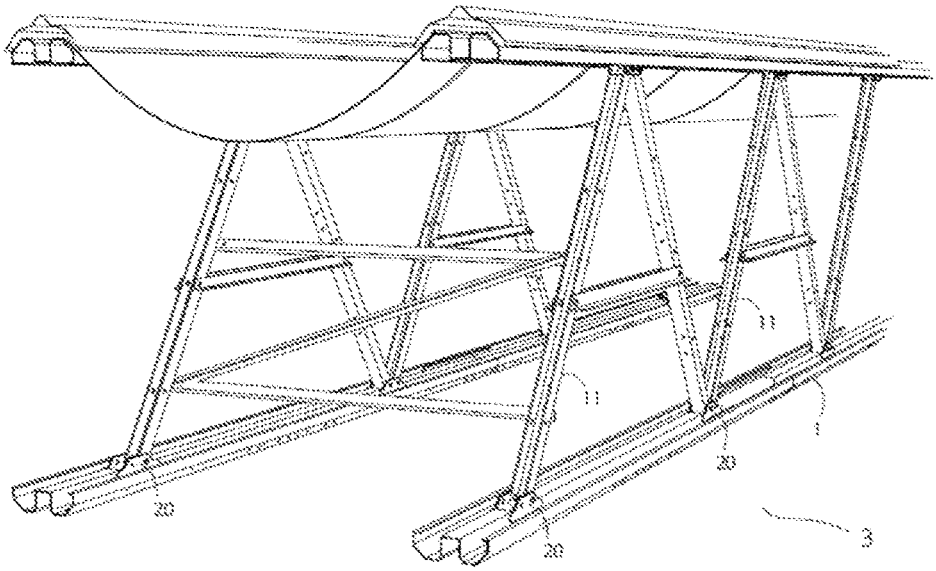
FIG. 1B refers to the same perspective view, but with the embodiment of the single shield reinforcement (20) installed in the beams.
Figure 1C:
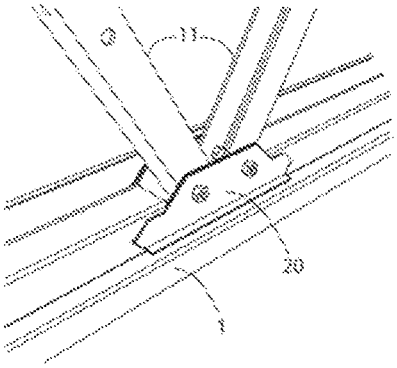
FIG. 1C refers to the embodiment of a single shield reinforcement (20) installed.
Figure 2A:
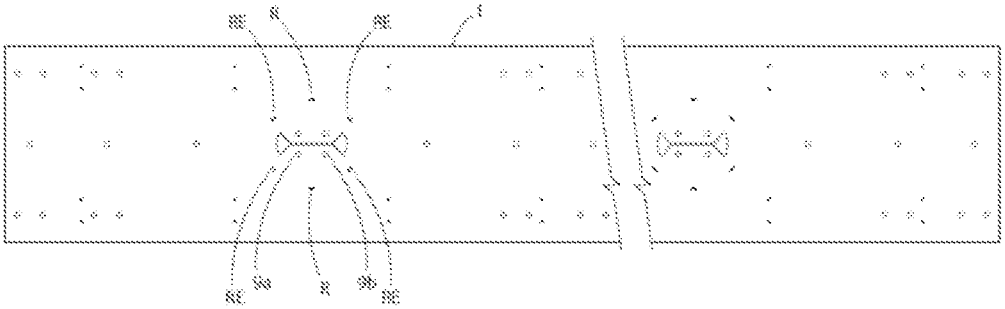
Figure 2B:
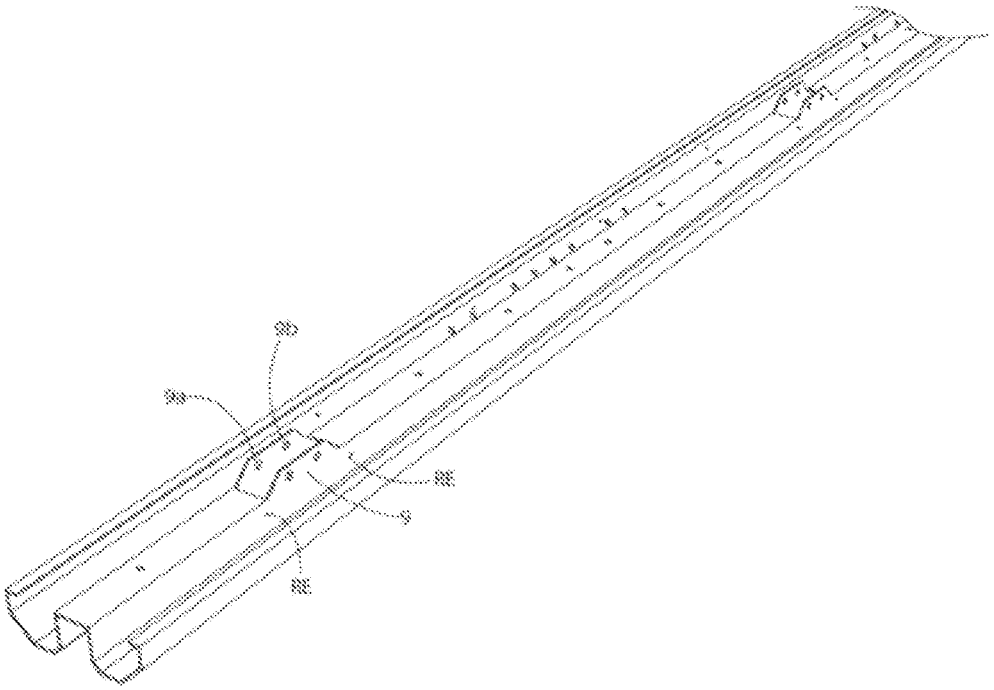
Figure 2C:
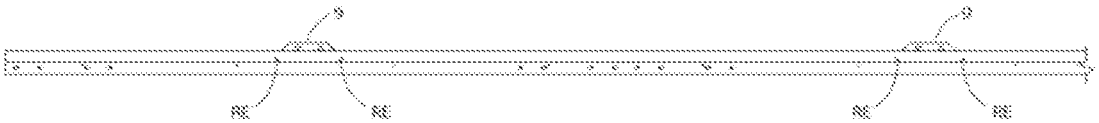

The present invention comprises, as shown in FIGS. 4A, 4B, 4C, 5A, 5B and 5C, two double shield reinforcement models (22 and 23) and comprising an improvement to an original shield reinforcement (20) applied to a specific covering system (3).

It can be considered in the calculation as if the connection were divided into two parts: shield connection (9) with a diagonal (11); and double-shield reinforcement connection (22 and 23) with a diagonal (11).

For the connection shield (9) and diagonal (11) it is considered that the shield was made by a plate twice as thick. In the case of the standard frame, with a thickness of 1.55 mm, the shield is in practice as if it were 3.10 mm thick. In this case, the weak point of this part of the connection becomes the diagonal, which can be 1.55 mm, 1.95 mm or 2.70 mm thick.

For the double shield reinforcement connection (22 and 23) and diagonal (11), the double shield reinforcement plate (22 and 23) is always considered as the weak point. The double shield reinforcement (22 and 23) has a thickness of 1.55 mm being a thickness equal to or less than the diagonals used.

In this way the final connection strength would be the sum of the two parts explained above. That is, two shield (9)/diagonal (11) connections; and two reinforcement connections of double shield (22 and 23)/diagonal (11).

Figure 4A:
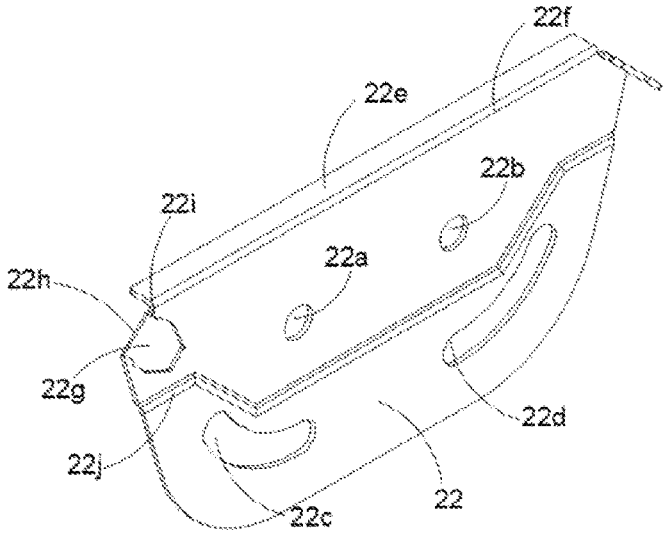
FIGS. 4A and 4B refer to perspective views of the first model of the double-shield reinforcement (22), highlighting its characteristics such as the fixing holes in the shield (22*a*, 22*b*), diagonal elongated fixing holes (22*c*, 22*d*), small and inclined tabs (22*g*), with indentations in the bases (221) of the tab, near the fold line of the tabs (22*h*), to be inserted into specific tears (RE) in the frames and stiffener in the base (22*e*), in 900 fold in the fold line (22*f*) in longitudinal section of the base of the shield reinforcement.
Figure 4B:
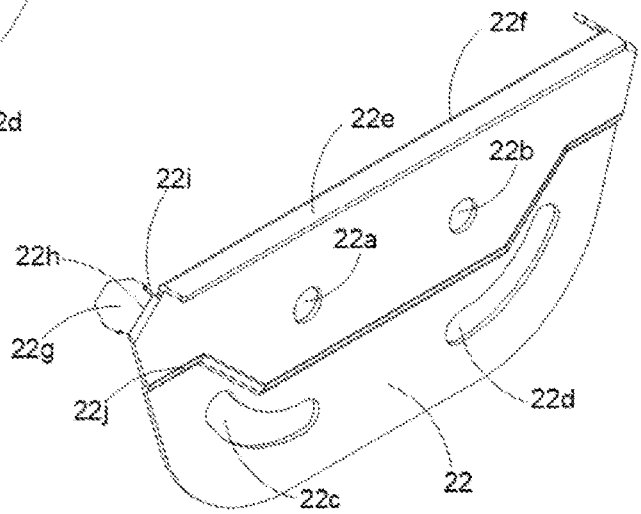
Figure 4C:
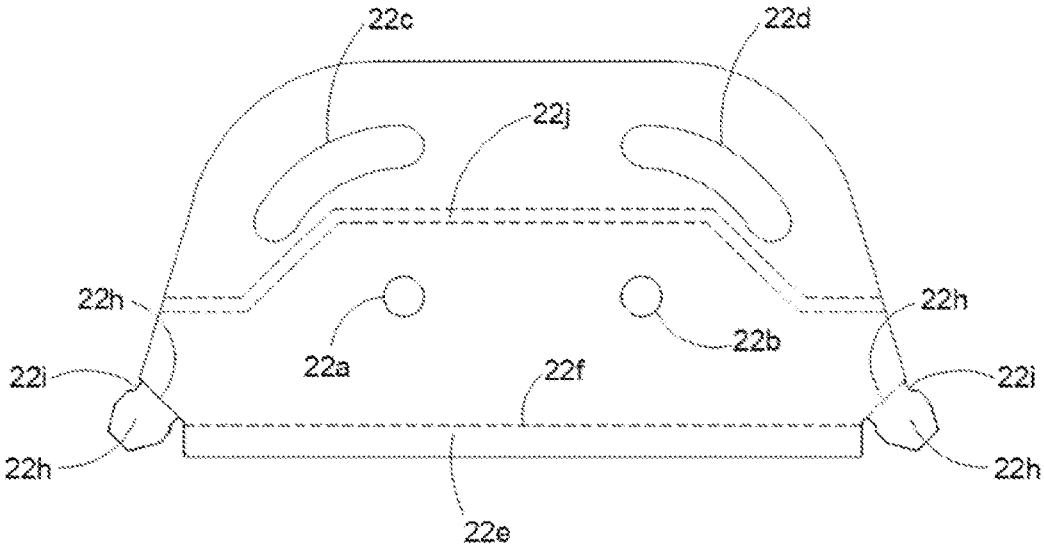
FIG. 4C refers to the first embodiment of the double-shield reinforcement after cutting and before folds (22*f*, 22*h*), highlighting its characteristic geometry described above.
Figure 4D:
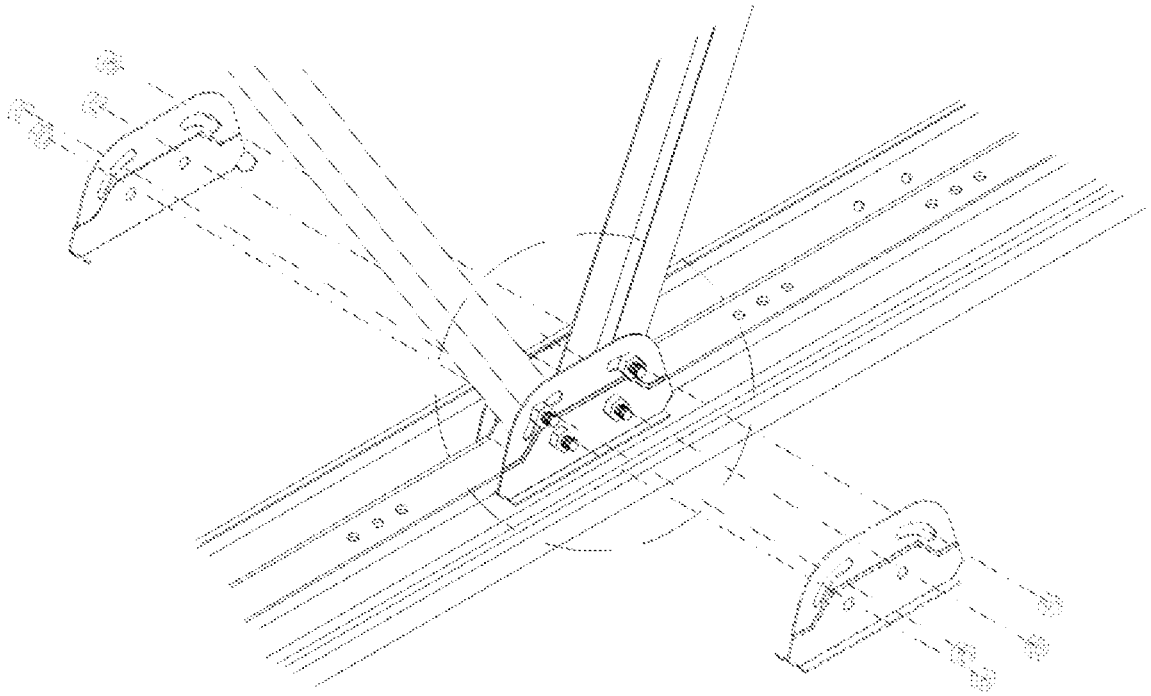
FIG. 4D is a perspective exploded view of a two-diagonal connection (11) to a shield (9) of the frame of a beam of the covering structure, highlighting the installation of double-shield reinforcements (22) on both sides of a shield (9) of the frame (1).
Figure 5A:
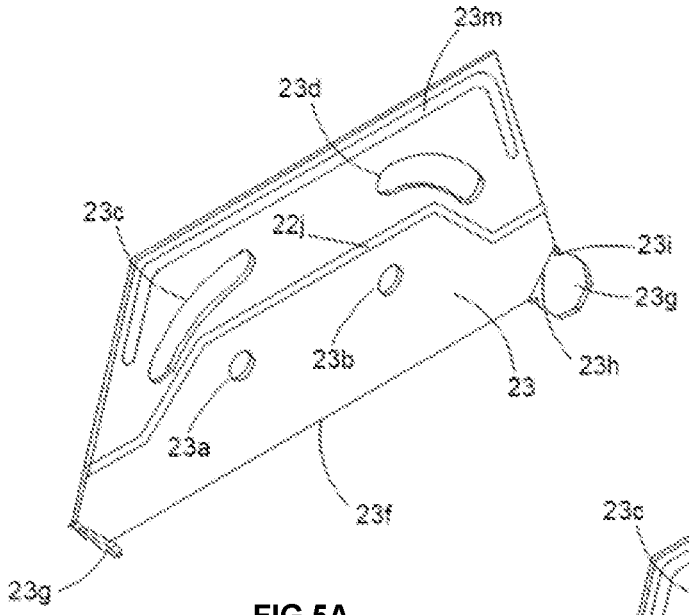
FIGS. 5A and 5B refer to perspective views of the second model of the double-shield reinforcement (23), highlighting its characteristics such as the fixing holes in the shield (23*a*, 23*b*), diagonal elongated fixing holes (23*c*, 23*d*), small and inclined tabs (23*g*), with indentations in the bases (231) of the tab, near the fold line of the tabs (23*h*), to be inserted into specific tears (RE) in the frames, stiffener in the base (23*e*), folded at 900 in the fold line (23*f*) in a longitudinal section of the base of the shield reinforcement, and stiffener along the edge of the part (23*m*).
Figure 5B:
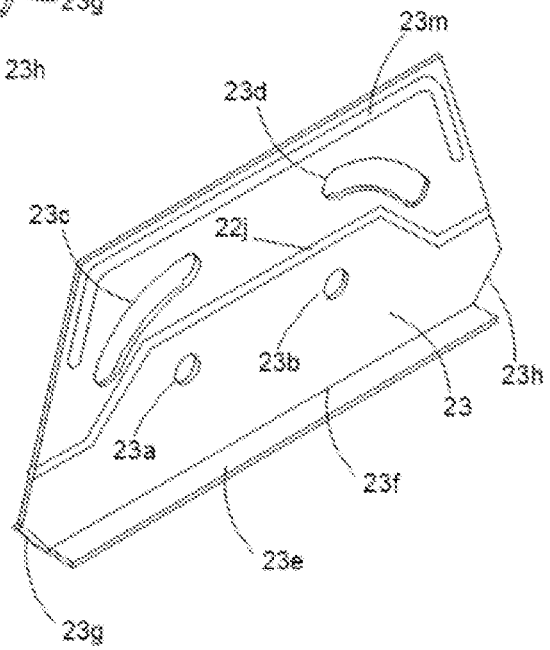
Figure 5C:
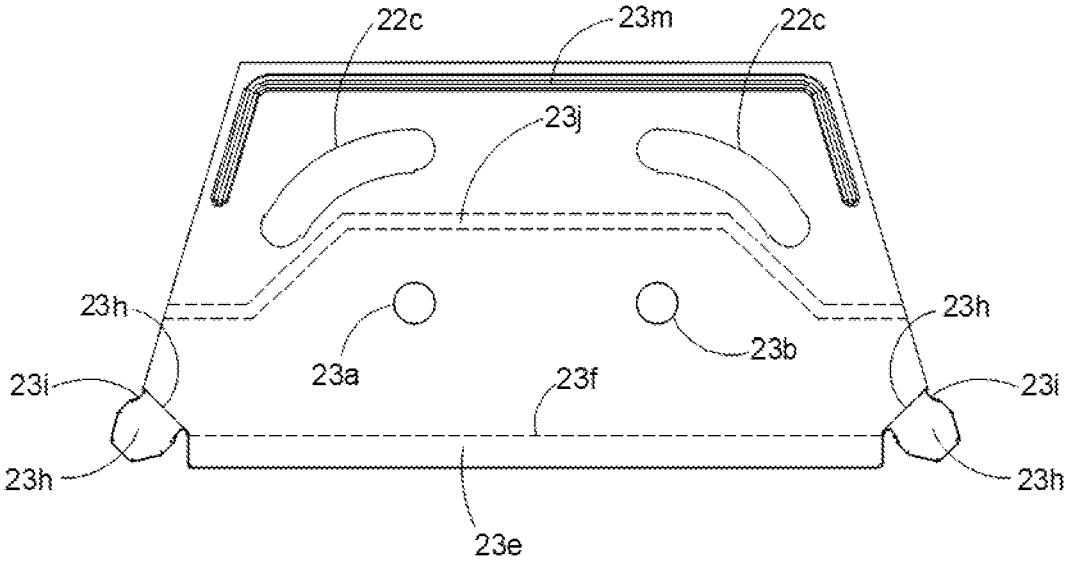
FIG. 5C refers to the second embodiment of the double-shield reinforcement after cutting and before folds (23*f*, 23*h*), highlighting its characteristic geometry described above.
Figure 5D:
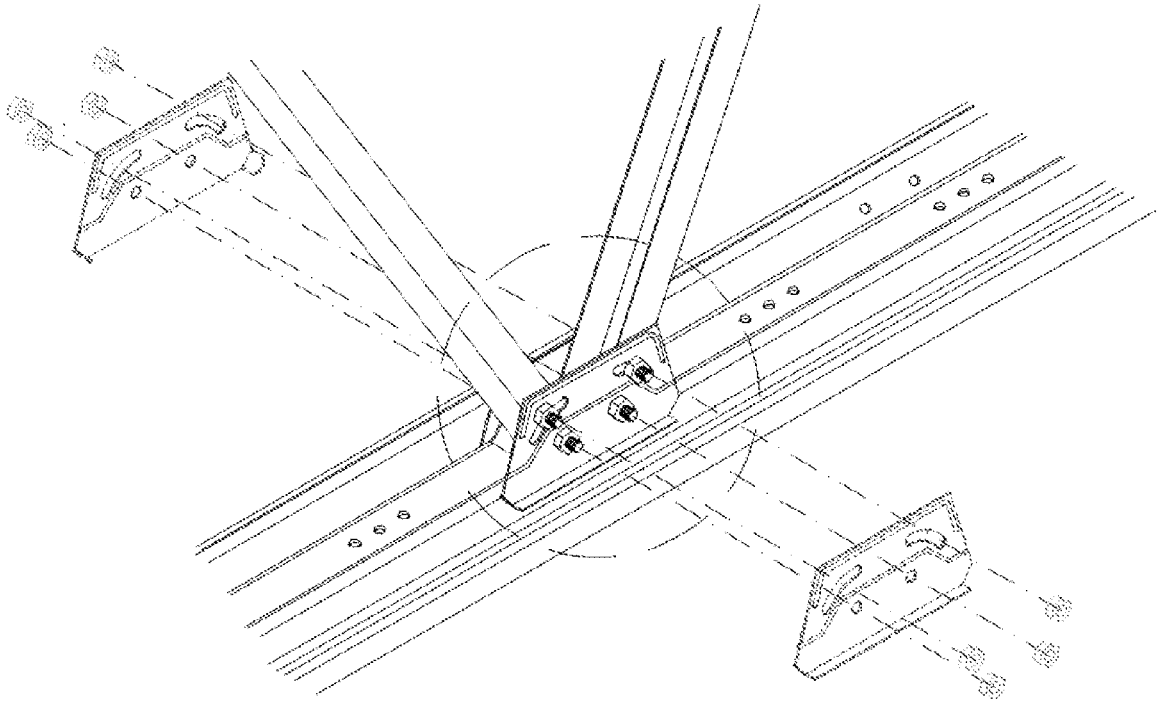
FIG. 5D is a perspective exploded view of a two-diagonal connection (11) to a shield (9) of the frame of a beam of the covering structure, highlighting the installation of double shield reinforcements (23) on both sides of a shield (9) of the frame (1).

The two double shield reinforcement embodiments (22 and 23) of the present invention attach to each shield (9) on both sides, from the outside of the frame, without the need for screwing, with fixation by tabs (22*g*) in cuts (RE) on the frame (1), as evidenced in FIG. 4D.

The double-shield reinforcement embodiments (22 and 23) claimed herein are formed by a galvanized steel sheet, of a thickness of 1.55 mm.

Said double-shield reinforcements (22 and 23) comprise two holes (22*a* and 22*b*, or 23*a* and 23*b*) for their attachment to the shield (9), two elongated holes (22*c*, 22*d*, or 23*c* and 23*d*) for attachment to the diagonals (11) and two small tabs inclined with respect to the frame (22*g* and 23*g*), according to FIGS. 4A, 4B, 4C, 5A, 5B and 5C.

Figure 3A:
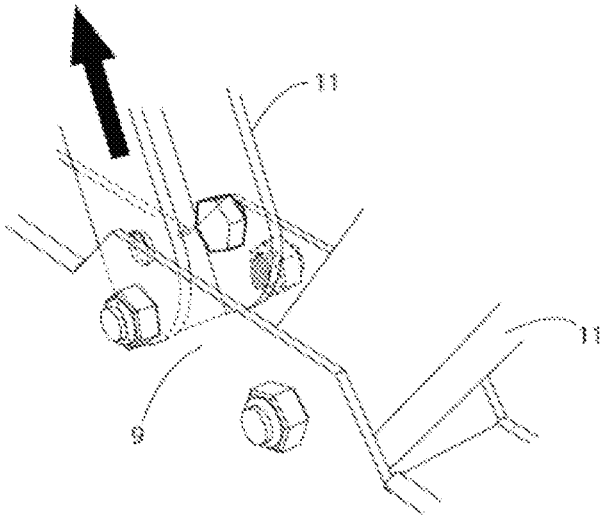
FIGS. 3A, 3B and 3C refer to perspective views of a two0diagonal connection (11) to a shield (9) of the frame (1) of a beam of the covering structure, where.
Figure 3B:
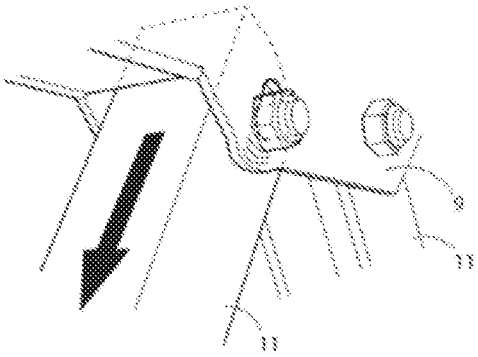
Figure 3C:
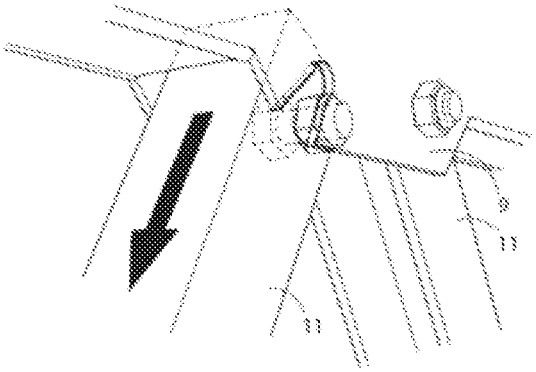

In both embodiments, the thickness of the plate of connecting zone is increased, leaving it reinforced against crushing (FIG. 3B) and tearing (FIG. 3C), avoiding rotation. In addition, by doubling the number of fastenings by adding holes 22*c* and 22*d*, or 23*c* and 23*d*.

The main difference between the first double-shield reinforcement embodiment (22) and the second double-shield reinforcement embodiment (23) lies in the fact that the second contains a stiffener along the edge of the part (23*m*).

However, the embodiment first of double-shield reinforcement (22) claimed herein, in addition to being more appropriate, comprises the preferred embodiment of the present invention.

Double shield reinforcement was developed for the initially revealed system, based on the needs presented. This does not prevent thicker plates from being used in both shield reinforcement and diagonals to withstand even greater load. Thus, the standard frame is maintained, reinforcing only the necessary points (shields).

Several tests have been carried out in the factory and in autonomous laboratories.

In factory tests, standard beams of the initially revealed system were used. The beams were mounted on two supports, spanning free spans of more than 20 meters, and in the shields closest to one of the supports were placed loads. Gradually, load was added at each point until it reached the collapse of a diagonal. In this way, the connections proved to be compatible with the construction system.

In the laboratories, the tests were limited to pull specimens with the reinforcements and diagonals of different thicknesses.

The following table shows the main results obtained in tests carried out in a specialized laboratory, accredited by INMETRO, with the connection with shield reinforcement with a thickness of 1.55 mm and diagonals with a thickness of 1.55 mm, 1.95 mm and 2.70 mm. The termination of both tests was not determined by actual collapse but by the continued decrease of the resistant force indicating the crushing of the hole and imminent collapse, indicated in the MAX. RESISTANT FORCE column of following table. We will call this phenomenon failure.

TABLE 1

| MODEL | YIELD LIMIT FORCE (kgf) | Max. resisting FORCE (kgf) | FAILURE SITE |
|---|---|---|---|
| 2.1 | 3761 | 4698 | Double-shield reinforcement |
| 2.1 | 3623 | 4514 | Double-shield reinforcement |
| 2.1 | 3795 | 4286 | Double-shield reinforcement |
| 2.1 | 3692 | 4495 | Double-shield reinforcement |
| 2.1 | 3770 | 4568 | Double-shield reinforcement |
| 2.1 | 3863 | 4195 | Double-shield reinforcement |
| Average | 3750.7 | 4459.3 | — |
| 2.2 | 4079 | 5076 | Double-shield reinforcement |
| 2.2 | 4008 | 5008 | Double-shield reinforcement |
| 2.2 | 4483 | 4975 | Double-shield reinforcement |
| 2.2 | 3833 | 4850 | Double-shield reinforcement |
| 2.2 | 4551 | 5344 | Double-shield reinforcement |
| 2.2 | 4299 | 5082 | Double-shield reinforcement |
| Average | 4208.8 | 5055.8 | — |
| 2.3 | 3839 | 5861 | Double-shield reinforcement |
| 2.3 | 4373 | 5759 | Double-shield reinforcement |
| 2.3 | 4210 | 5782 | Double-shield reinforcement |
| 2.3 | 4052 | 5424 | Double-shield reinforcement |
| 2.3 | 4484 | 5622 | Double-shield reinforcement |
| 2.3 | 4388 | 5568 | Double-shield reinforcement |
| Average | 4224.3 | 5669.3 | — |

Tested Models:

1—Frame with a thickness of 1.55, connection with double shield reinforcement and diagonal with a thickness of 1.55 mm.

2—Frame with a thickness of 1.55, connection with double shield reinforcement and diagonal with a thickness of 1.95 mm.

3—Frame with a thickness of 1.55, connection with double shield reinforcement and diagonal with a thickness of 2.70 mm.

The Brazilian—NBR 14762—and North American—AISI—standards allow a screwed connection to be sized, based on the results of laboratory tests. In this case, the laboratory must be suitable, with adequate and calibrated equipment, in addition to having professionals with proven experience in the preparation and execution of tests. The prototype to be tested, its assembly, the value of the load and the manner of application of the load must be consistent with the service conditions of the structure. In the tests, the actions applied corresponding to the final limit states established in each case are determined. The value of these actions is called "nominal value of resistant stress". The resistant stress of calculation is determined by the relationship between the nominal value of the resistant stress and the resistance weighting coefficient (γ), calculated by the formula:

$$\gamma = \frac{1}{1.52(XmXf)e^{-\beta 0\sqrt{\delta m^2+\delta f^2+Cp\delta t^2+0.044}}}$$

Where: (by table 17—Statistical data for determination of resistance weighting coefficient—page 68 of NBR 14762)

$\square_m$ =1.10

$\square_f$ =1.00

$\beta_0$=3.50

$\square_m$ =0.08

$\square$ =1.421

$\square_f$ =0.05

$\square_t$ =6.5%

$C_p$=1.94

Model 2.1:

Resistant Calculation Effort: 4459.3/1.421=3138 kgf

Model 2.2:

Resistant Calculation Effort: 5055.8/1.421=3558 kgf

Model 2.3:

Resistant Calculation Effort: 5669.3/1.421=3990 kgf

Thus, for the sizing of the connection, the crush-resistant force of the diagonal holes and the double shield reinforcement must be added. This resistance can be obtained through the formula of the Brazilian standard itself for the Contact Pressure (hole crushing) of the diagonals and double shield reinforcement.

$$Frd = \frac{\alpha e \cdot d \cdot t \cdot fu}{\gamma}$$

Where:

Frd=Resistant force from calculation to crushing;

$$a_e = (0.183 \cdot t) + 1.53;$$

d=screw diameter—⅜"≈9.525 mm; t=element thickness;

Fu=breaking strength of the steel of the analyzed element;

$\square$ =1.55.

Thus, we will have the following theoretical resistances:

| THICKNESS | PART | Fu (MPa) | Frd (tf) |
|---|---|---|---|
| 1.55 mm | Diagonal | 410 | 0.71 |
| | Shield | 422 | 0.73 |
| 1.95 mm | Diagonal | 406 | 0.92 |
| 2.70 mm | Diagonal | 375 | 1.26 |

1.55 mm Diagonal:

As there are 4 screws, and the diagonal plates are of a lower resistance: 0.71×4=2.84 tf.

1.95 mm Diagonal:

As there are 2 screws resisting in connecting diagonal #1.95 mm with reinforced frame; and 2 in the double shield reinforcement #1.55 with diagonal: 0.92×2+0.73×2=3.30 tf.

2.70 mm Diagonal:

As there are 2 screws resisting in connecting diagonal #1.95 mm with reinforced frame; and 2 in the double shield reinforcement #1.55 with diagonal: 0.92×2+0.73×2=3.98 tf.

Comparing these theoretical values with those determined based on the tests, we can note that the theoretical values are lower than those obtained through the tests:

1.55 mm diagonal: 2.84<3.14 tf 1.95 mm diagonal: 3.30<3.56 tf 2.70 mm diagonal: 3.98<3.99 tf To better compare with the results obtained, the strengths obtained for the same thicknesses are presented, but using the simple shield reinforcement (20), presented in the previous patent:

1.55 mm diagonal: 1.41 tf 1.95 mm diagonal: 1.84 tf 2.70 mm diagonal: 2.52 tf

It was concluded from these results that:

Using the double shield reinforcement proved to be more efficient than the shield from the previous patent.

For diagonals of thickness 1.55 mm, the resistance was increased by 100%, as the previous reinforcement was not applied to this thickness.

For the other thicknesses, the increase in resistance was about 79% for diagonals #1.95 mm and 58% for diagonals #2.70.

The beams whose sizing is conducted by the connections have their resistance considerably increased, with an increase in weight and price negligible.

DESCRIPTION OF THE ELEMENTS OF THE FIGURES

For better understanding of the present invention, the following list of elements and/or components is presented:

1—Frame

RE—tear in the frame for shield reinforcements

3—structure (frame+diagonals+crossings)

9—shield

11—diagonal

22—first embodiment of Double Shield Reinforcement

22*a*, 22*b*—standard holes of Double Shield Reinforcement

22*c*, 22*d*—elongated holes of Double Shield Reinforcement

22*e*—lower stiffener (fold) of Double Shield Reinforcement

22*f*—lower stiffening fold line

22*g*—Double Shield Reinforcement tabs

22*h*—fold line of tab

22*i*—recesses at the bases of tabs

22*j*—adaptation fold

23—second embodiment of Double Shield Reinforcement

23*a*, 23*b*—standard holes of Double Shield Reinforcement

23*c*, 23*d*—elongated holes of Double Shield Reinforcement

23*e*—lower stiffener (fold) of Double Shield Reinforcement

23*f*—lower stiffening fold line

23*g*—Double Shield Reinforcement tabs 23*h*—fold line of tab

22*i*—recesses at the bases of tabs 22*j*—adaptation fold

23*m*—stiffener along the upper sides of the Double Shield Reinforcement.

DESCRIPTION OF THE ELEMENTS OF THE FIGURES

This shield reinforcement improvement (22) will be described in detail, with reference to the accompanying drawings, as follows.

The main object of the present invention comprises a part called Double Shield Reinforcement (22), with substantial improvements over the prior art, Shield Reinforcement (20), with various reflections on the covering structure of the present invention.

Said Double Shield Reinforcement (22), comprises a steel plate of approximately 1 to 3 mm thick, shaped in a characteristic form by a continuous process tool, comprising 4 (four) holes, two of them being standard (22*a*, 22*b*) and two of them elongated (22*c*, 22*d*), a pair of fins (22*g*), also called tabs and fold (22*e*) at 90° at its base, called lower stiffener.

Said standard holes (22*a*, 22*b*) allow the double-shield reinforcements to be connected to the outer faces of the shells (1) in the region of the shells (9), aligned with the holes therein and with two diagonal holes (11). The elongated holes (22*c*, 22*d*) allow the double-shield reinforcements to be connected to two diagonal holes. These connections are made by screws that, fixed to the nuts, promote the connections of the beam.

Figure 6A:
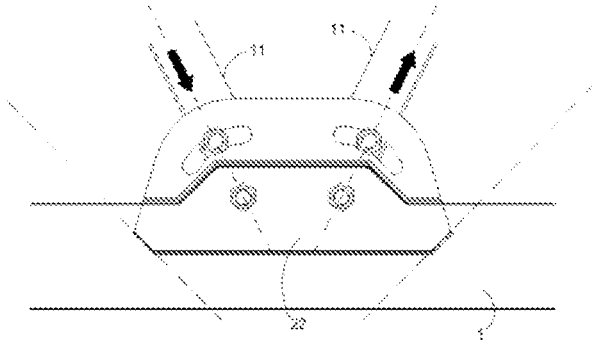
FIG. 6A schematically depicts a shield with the first embodiment of the double shield reinforcement (22) being subjected to diagonal compression loads (11) on the left and diagonal traction (11) on the right.
Figure 6B:
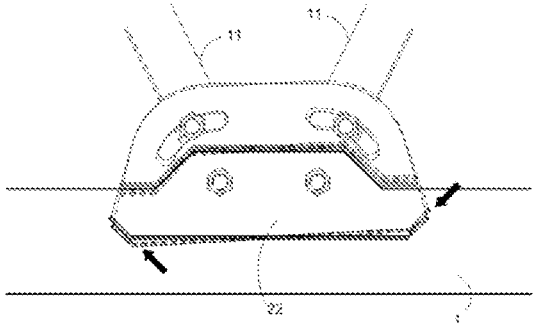
FIG. 6B schematically depicts a frame shield (1) with the first embodiment of the double shield reinforcement (22), emphasizing the rotation of the double shield reinforcement (22) imposed by the charges and prevented by the tabs (22*g*) of the double shield.
Figure 7A:
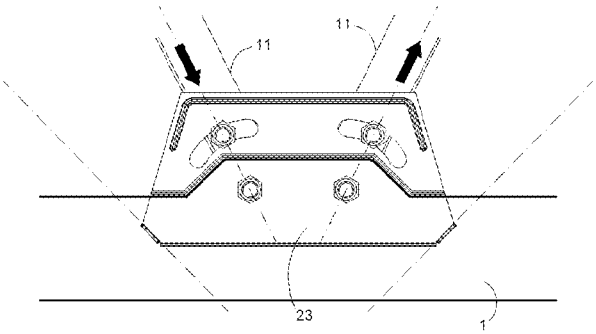
FIG. 7A schematically depicts a shield with the second embodiment of the double shield reinforcement (23) being subjected to diagonal compression loads (11) on the left and diagonal traction (11) on the right.
Figure 7B:
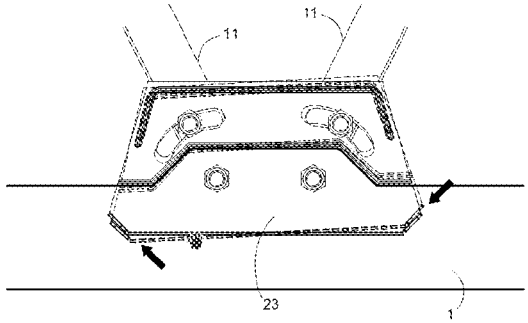
FIG. 7B schematically depicts a frame shield (1) with the second embodiment of the double shield reinforcement (23), emphasizing rotation of the double shield reinforcement (23) imposed by the charges and prevented by the tabs (23*g*) of the double shield reinforcement.

The pair of tabs (22*g*), folded at 90° relative to the surface of the part, are introduced into the tears (RE) of the frame (1) limiting the twisting of the shield reinforcement in relation to its center, caused by the efforts coming from the diagonals (FIGS. 6B and 7B). Said tabs have recesses (22*i*) at their bases, which anchor to the shield plate, making it difficult for the tabs to move away from the frame, due to the deformation caused by the stresses on the reinforcement plate.

ADVANTAGES OF THE INVENTION

The present invention provides a double shield reinforcement (22) which promotes a substantial increase (from 58% to 100%) in the strength of the connection of the diagonals with the frames. As several times the beam is sized by these connections, it also increases the strength of the covering beams of the initially revealed system, without a corresponding increase in weight of the structure.

The double-shield reinforcement of the present invention is used at determined points, that is, only in shields whose diagonals involved receive tensile or compressive load greater than the strength of the connection without reinforcement, which occurs in shields close to supports or load concentration zones. It is not necessary to use double shield reinforcements on all shields of a beam.

The double-shield reinforcement of the present invention is easy to assemble and only used screws already existing in the beam of the initially disclosed system.

The manufacture of shield reinforcement does not require large investments, simply adapting new tools to the equipment already used in the factory.

The resistance of the shields with reinforcements, obtained in the laboratory tests, is numerically greater than the theoretical strength of the diagonals in the connection, obtained through the formulae mentioned above to determine the strength of the beam connections according to the Brazilian standard NBR 14762:2010 or AISI 8100:2016.

Therefore, the determination of the strength of the beam connections, even with double shield reinforcements, is quite simple, simply by using said theoretical formulae of general knowledge.

The invention claimed is:

1. A system comprising:

a beam comprising a shield that defines a first shield hole and a second shield hole, wherein the beam further defines a first tear and a second tear;

a first diagonal member that defines a first diagonal member hole;

a second diagonal member that defines a second diagonal member hole; and a reinforcement plate configured for reinforcing connection of the first diagonal member and the second diagonal member to the beam, wherein the reinforcement plate includes:

a main portion defining a first circular hole, a second circular hole, a first elongated hole, and a second elongated hole, and a first tab and a second tab extending from the main portion, wherein the first tab and second tab are folded 90° in relation to the main portion, wherein the reinforcement plate is configured for reinforcing connection of the first diagonal member and the second diagonal member to the beam by:

aligning the first circular hole and the second circular hole of the reinforcement plate with the first shield hole and the second shield hole of the beam, respectively, aligning the first elongated hole and the second elongated hole of the reinforcement plate with the first diagonal member hole of the first diagonal member and the second diagonal member hole of the second diagonal member, respectively, inserting the first tab and the second tab of the reinforcement plate into the first tear and the second tear of the beam, respectively, inserting respective screws through the first and second circular holes and the first and second elongated holes, and fixing respective nuts to the respective screws, such that the reinforcement plate reinforces connection of the first diagonal member and second diagonal member to the beam.

2. The system according to claim 1, wherein the reinforcement plate is formed by a steel plate that is approximately 1 to 3 mm thick.

3. The system according to claim 1, wherein the main portion of the reinforcement plate comprises an adaption fold.

4. The system according to claim 1, wherein the reinforcement plate further comprises a stiffening fold that extends from the main portion.

5. The system according to claim 4, wherein the first tab and the second tab of the reinforcement plate extend from the main portion in a first direction, and the stiffening fold of the reinforcement plate extends from the main portion in a second direction that is opposite to the first direction.

6. The system according to claim 1, wherein the first elongated hole and the second elongated hole are arcuate in shape.

7. The system according to claim 1, wherein:

the first circular hole and the second circular hole of the reinforcement plate are respectively aligned with the first shield hole and the second shield hole of the beam, the first elongated hole and the second elongated hole of the reinforcement plate are respectively aligned with the first diagonal member hole of the first diagonal member and the second diagonal member hole of the second diagonal member, the first tab and the second tab of the reinforcement plate are respectively inserted into the first tear and the second tear of the beam, the respective screws are inserted through the first and second circular holes and the first and second elongated holes, and the respective nuts are fixed to the respective screws, such that the reinforcement plate reinforces connection of the first diagonal member and second diagonal member to the beam.

8. A system comprising:

a beam comprising a first shield and a second shield that are spaced from each other, wherein the first shield and the second shield each define a first shield hole and a second shield hole, wherein the beam further defines a first tear, a second tear, a third tear, and a fourth tear;

a first diagonal member that defines a first diagonal member hole;

a second diagonal member that defines a second diagonal member hole; and a first reinforcement plate and a second reinforcement plate configured for reinforcing connection of the first diagonal member and the second diagonal member to the beam, wherein the first reinforcement plate and the second reinforcement plate each include:

a main portion defining a first circular hole, a second circular hole, a first elongated hole, and a second elongated hole, and a first tab and a second tab extending from the main portion, wherein the first tab and the second tab are folded 90° in relation to the main portion, wherein the first reinforcement plate and second reinforcement plate are configured for reinforcing connection of the first diagonal member and the second diagonal member to the beam by:

arranging the first diagonal member and the second diagonal member between the first shield and the second shield of the beam, aligning the first circular hole of the first reinforcement plate, the first circular hole of the second reinforcement plate, the first shield hole of the first shield, and the first shield hole of the second shield, aligning the second circular hole of the first reinforcement plate, the second circular hole of the second reinforcement plate, the second shield hole of the first shield, and the second shield hole of the second shield, aligning the first elongated hole of the first reinforcement plate, the first elongated hole of the second reinforcement plate, and the first diagonal member hole of the first diagonal member, aligning the second elongated hole of the first reinforcement plate, the second elongated hole of the second reinforcement plate, and the second diagonal member hole of the second diagonal member, inserting the first tab and the second tab of the first reinforcement plate into the first tear and the second tear of the beam, respectively, inserting the first tab and the second tab of the second reinforcement plate into the third tear and the fourth tear of the beam, respectively, inserting a first screw through the first circular hole of the first reinforcement plate, the first circular hole of the second reinforcement plate, the first shield hole of the first shield, and the first shield hole of the second shield, and fixing a first nut to the first screw, inserting a second screw through the second circular hole of the first reinforcement plate, the second circular hole of the second reinforcement plate, the second shield hole of the first shield, and the second shield hole of the second shield, and fixing a second nut to the second screw, inserting a third screw through the first elongated hole of the first reinforcement plate, the first elongated hole of the second reinforcement plate, and the first diagonal member hole of the first diagonal member, and fixing a third nut to the third screw, and inserting a fourth screw through the second elongated hole of the first reinforcement plate, the second elongated hole of the second reinforcement plate, and the second diagonal member hole of the second diagonal member, and fixing a fourth nut to the fourth screw, such that the first reinforcement plate and the second reinforcement plate reinforces connection of the first diagonal member and the second diagonal member to the beam.

9. The system according to claim 8, wherein the first reinforcement plate and the second reinforcement plate are each formed by a steel plate that is approximately 1 to 3 mm thick.

10. The system according to claim 8, wherein for each of the first reinforcement plate and the second reinforcement plate, the main portion comprises an adaption fold.

11. The system according to claim 8, wherein the first reinforcement plate and the second reinforcement plate each further comprise a stiffening fold that extends from the main portion.

12. The system according to claim 8, wherein for each of the first reinforcement plate and the second reinforcement plate, the first tab and second tab extend from the main portion in a first direction, and the stiffening fold extends from the main portion in a second direction that is opposite to the first direction.

13. The system according to claim 8, wherein the first elongated hole and the second elongated hole of the first reinforcement plate and the second reinforcement plate are arcuate in shape.

14. The system according to claim 8, wherein:

the first diagonal and the second diagonal are arranged between the first shield and the second shield of the beam, the first circular hole of the first reinforcement plate, the first circular hole of the second reinforcement plate, the first shield hole of the first shield, and the first shield hole of the second shield are aligned, the second circular hole of the first reinforcement plate, the second circular hole of the second reinforcement plate, the second shield hole of the first shield, and the second shield hole of the second shield are aligned, the first elongated hole of the first reinforcement plate, the first elongated hole of the second reinforcement plate, and the first diagonal hole of the first diagonal are aligned, the second elongated hole of the first reinforcement plate, the second elongated hole of the second reinforcement plate, and the second diagonal hole of the second diagonal are aligned, the first tab and the second tab of the first reinforcement plate are inserted into the first tear and the second tear of the beam, respectively, the first tab and the second tab of the second reinforcement plate are inserted into the third tear and the fourth tear of the beam, respectively, the first screw is inserted through the first circular hole of the first reinforcement plate, the first circular hole of the second reinforcement plate, the first shield hole of the first shield, and the first shield hole of the second shield, and the first nut is fixed to the first screw, the second screw is inserted through the second circular hole of the first reinforcement plate, the second circular hole of the second reinforcement plate, the second shield hole of the first shield, and the second shield hole of the second shield, and the second nut is fixed to the second screw, the third screw is inserted through the first elongated hole of the first reinforcement plate, the first elongated hole of the second reinforcement plate, and the first diagonal hole of the first diagonal, and the third nut is fixed to the third screw, and the fourth screw is inserted through the second elongated hole of the first reinforcement plate, the second elongated hole of the second reinforcement plate, and the second diagonal hole of the second diagonal, and the fourth nut is fixed to the fourth screw, such that the first reinforcement plate and the second reinforcement plate reinforces connection of the first diagonal and the second diagonal to the beam.

* * * * *